US005080258A

United States Patent [19]

Hinterreiter

[11] Patent Number: 5,080,258

[45] Date of Patent: Jan. 14, 1992

[54] TABLET DISPENSER

[76] Inventor: Ignaz Hinterreiter, Ramsauerstrasse 119, A-4020 Linz, Austria

[21] Appl. No.: 609,580

[22] Filed: Nov. 6, 1990

[30] Foreign Application Priority Data

Nov. 16, 1989 [AT] Austria ..... 2618/89

[51] Int. Cl.[5] ..... B65H 1/00

[52] U.S. Cl. ..... 221/198; 221/229; 221/232; 221/279

[58] Field of Search ..... 221/228, 229, 226, 279, 221/231, 232, 59, 269, 198; 206/536, 535; 312/61, 71

[56] References Cited

U.S. PATENT DOCUMENTS 2,833,442 5/1958 Larsen ..... 312/71
3,612,349 10/1971 Thomas ..... 221/232
3,942,683 3/1976 Haas ..... 221/229

FOREIGN PATENT DOCUMENTS 716514 10/1954 United Kingdom ..... 221/232

*Primary Examiner*—H. Grant Skaggs
*Attorney, Agent, or Firm*—Collard, Roe & Galgano

[57] ABSTRACT

A tablet dispenser comprises a tubular housing for a drawer, which has a side wall opening through which a stack of tablets can be inserted into the drawer. A pusher is guided in the drawer and has at least one stop, which cooperates with a counterstop of the housing. A compression spring is supported on the bottom of the drawer and on the pusher and by means of the pusher pushes the tablets to the top end of the drawer. An ejector for individually ejecting the tablets is provided adjacent to said top end. Besides, the spring pushes the drawer to its retracted position in the housing. The stop or stops of the pusher is or are adapted to be forced into the housing through the open top end thereof with an elastic deformation of said stop or stops or of the pusher so that the stop or stops will be able to resiliently snap into grooves which are formed in the housing and closed near its open top end.

4 Claims, 1 Drawing Sheet

TABLET DISPENSER

FIELD OF THE INVENTION

This invention relates to a tablet dispenser comprising a tubular housing, which defines a guide passage for a drawer, which is adapted to be extracted out of the top end of the housing to a stop-defined position and has a side wall opening and is adapted to receive a stack of tablets inserted through said opening, also comprising a pusher, which is integrally formed with at least one stop, which extends into a longitudinal track of the housing and cooperates with a counterstop provided at the top end of the housing from which the drawer can be extracted, also comprising a compression spring, which biases the pusher and preferably conforms to the cavity of the drawer and is backed adjacent to the bottom end of the drawer so that the compression spring tends to raise by means of the pusher the tablets along the drawer as far as to an ejector, which is engageable with the stack adjacent to its top end and is operable to eject each of said tablets from the top of said stack transversely to the longitudinal direction of the stack while said tablet is guided between said guides adjacent to the ejector, and the compression spring urges the drawer downwardly in the housing.

DESCRIPTION OF THE PRIOR ART

Such tablet dispensers are preferably used for dispensing tablets which can easily be assembled to form a columnlike stack, such as tablets having a prismatic or cylindrical peripheral surface. A main field of application are tablet dispensers for refreshing tablets and lozenges, which have basically the shape of a rectangular prism and contact each other with their broad sides in the stack.

In known tablets dispensers of the present kind the drawer comprises side wall extensions which when the drawer has fully been inserted into the housing protrude above the top end of the housing and said extensions carry pivot pins for the ejector, which is held in a position in which it seals the ejection opening for the tablets. The side wall extensions of the drawer constitute also the laterally disposed tracks for guiding the tablets adjacent to the ejector. In tablet dispensers which are of the present kind and intended for rectangular prismatic tablets the narrow side face of the pusher are integrally formed with stop-forming rigid noses and the entire pusher is also substantially rigid. The longitudinal tracks of the protective housing consist of grooves, which are partly closed at the outer end of the protective housing. When the pusher has been inserted into the drawer, one nose of the pusher protrudes out of the housing through the opening formed in the drawer for receiving the tablets and the somewhat longer second nose extends through a slot in the opposite wall of the drawer. When that tablet dispenser is to be assembled, the spring is initially hung behind a claw, which is provided in the bottom wall of the drawer, and the pusher is inserted into the drawer through the opening for receiving the tablets. Thereafter the pusher is moved toward the bottom wall of the drawer, whereby the spring is compressed, and the drawer is then inserted into the housing through the open top end of the latter while the spring is still compressed and held in its stressed position by the pusher and the drawer is held in an inclined position relative to the housing so that the distance from the projections of the stop noses relative to the open top end of the housing is decreased. One nose is subsequently hung into the associated groove and while the pusher is still held in position the drawer is tilted into alignment with the housing and is partly inserted and the initially inclined pusher is moved into the groove which constitutes the second longitudinal track past the partly closed end of said groove and is then moved to an aligned position. When the drawer is then released, the spring, which by the stops of the pusher is supported on the housing, will urge the drawer to its inserted position. That assembling operation can be performed only by hand and requires a certain skill and the spring which is entirely or partly prestressed may jump out of may force apart said parts during the assembling operation when the drawer is released carelessly so that the assembling operation must then be repeated from the beginning. Springs which jump off may even cause an injury to the workers. Besides, tablet dispensers of the present kind are definitely mass-produced articles and the assembling costs have previously constituted a large share of the total manufacturing costs. A decisive disadvantage of the known tablet dispensers resides in that the dispenser may inadvertently be knocked down if it is carlessly or wantonly handled or even in case of slight damage to the housing adjacent to its open top end. For instance, when the drawer is extracted and is tilted as for the assembling, the stop noses may leave the grooves and the spring, which has highly been prestressed by the extraction of the drawer, may jump out so that the pusher is also thrown out and the spring will jump away along an uncontrolled trajectory. Such an inadvertent automatic knocking down may be permitted even by slight damage to the protective housing. Because springs jumping out may inflict injuries to the face or eyes and the known tablet dispensers are objectionable also from the aspect of product liability owing to that risk.

SUMMARY OF THE INVENTION

It is an object of the invention to provide a tablet dispenser which is of the kind described first hereinbefore and which can easily be assembled, preferably when the spring is at least partly relaxed, and can be assembled even by automatic machines if this is desired. Besides, an inadvertent knocking down and a resulting jumping out of the spring are substantially precluded unless the entire tablet dispenser is intentionally destroyed.

The object set forth is accomplished in that the longitudinal track of the housing consists of at least one groove, which is inwardly open but at the top end of the housing is closed as far as to the top end of the guide passage for the drawer, and that when the pusher and the spring have been inserted into the drawer during the assembling operation the stop or stops of the pusher is or are adapted to be forced into the guide passage through the open top end of said housing part said stop or stops whereby said stop or stops or that part of the pusher which carries said stop or stops is or are elastically deformed and are adapted to recover from such deformation as they snap into the groove or grooves which constitute the longitudinal track.

In the assembling of the tablet dispenser in accordance with the invention the pusher and the spring can be inserted into the drawer and the assembling in the housing may be effected after the drawer has partly been inserted and is aligned with the housing and in that the pusher is simply pushed through the open top end of the housing. This will initially result in the elastic deformation and will then permit the stop or stops to snap into the groove or grooves. The groove or grooves may have a sufficient depth so that their closed ends will constitute reliable stops for engagement by the stop or stops of the pusher. Because the assembling is simple, the entire assembling or a substantial part of it may be performed on automatic machines.

In accordance with a preferred feature the stop or stops consists or consist of an edge portion which is formed on the pusher and which during the inserting operation faces the open top end of the housing and the pusher consists of an open-bottomed cap, which contains the top end of the spring and has a bottom arm, and the stop or stops consist of tongues, which are integrally formed with said rim and are upwardly and outwardly inclined and after their insertion into the housing spread into the groove or grooves.

The inclination of the tongues requires them to be wedge-shaped so that their sliding insertion into the housing will be facilitated. As the tongues strike against the closed groove ends, the pressure exerted by the spring or an extracting force exerted on the drawer will promote the spreading of said tongues so that they will apply pressure also to the bottom of the groove and will actually lock the tablet dispenser in its assembled position. A knocking down of the dispenser is virtually precluded unless the housing is crushed. Even an attempt to knock down the dispenser by a canting of the extracted drawer will not be successful unless the housing is broken.

The holding of the spring in position can further be improved and the assembling can further be facilitated in that noses or claws for catching the ends of the spring are provided adjacent to the bottom wall of the drawer and in the cavity of the pusher and said catching noses or claws preferably protrude from the walls of the drawer and pushes into the space for receiving the spring and between their free ends and the bottom wall of the drawer and the top of the pusher cap define gaps which when the spring is compressed are arranged to receive the terminal convolutions of the coil spring, which has a peripheral configuration conforming to the inside surface of the drawer. The width of each gap is approximately as large as the diameter of the spring wire so that when the spring is completely compressed that spring wire can slip in under the nose or claw and will be retained by the nose or claw as the spring is partly relaxed. As a result, the spring and pusher cannot be thrown out of the drawer even when the housing has been broken because the pusher and the spring are retained on the drawer by the noses. The assembling will substantially be simplified because it is sufficient to insert the spring and to compress it once so that the catching noses will engage the adjacent terminal convolutions of the spring.

DETAILED DESCRIPTION OF THE PREFERRED EMBODIMENT

Figure 1:
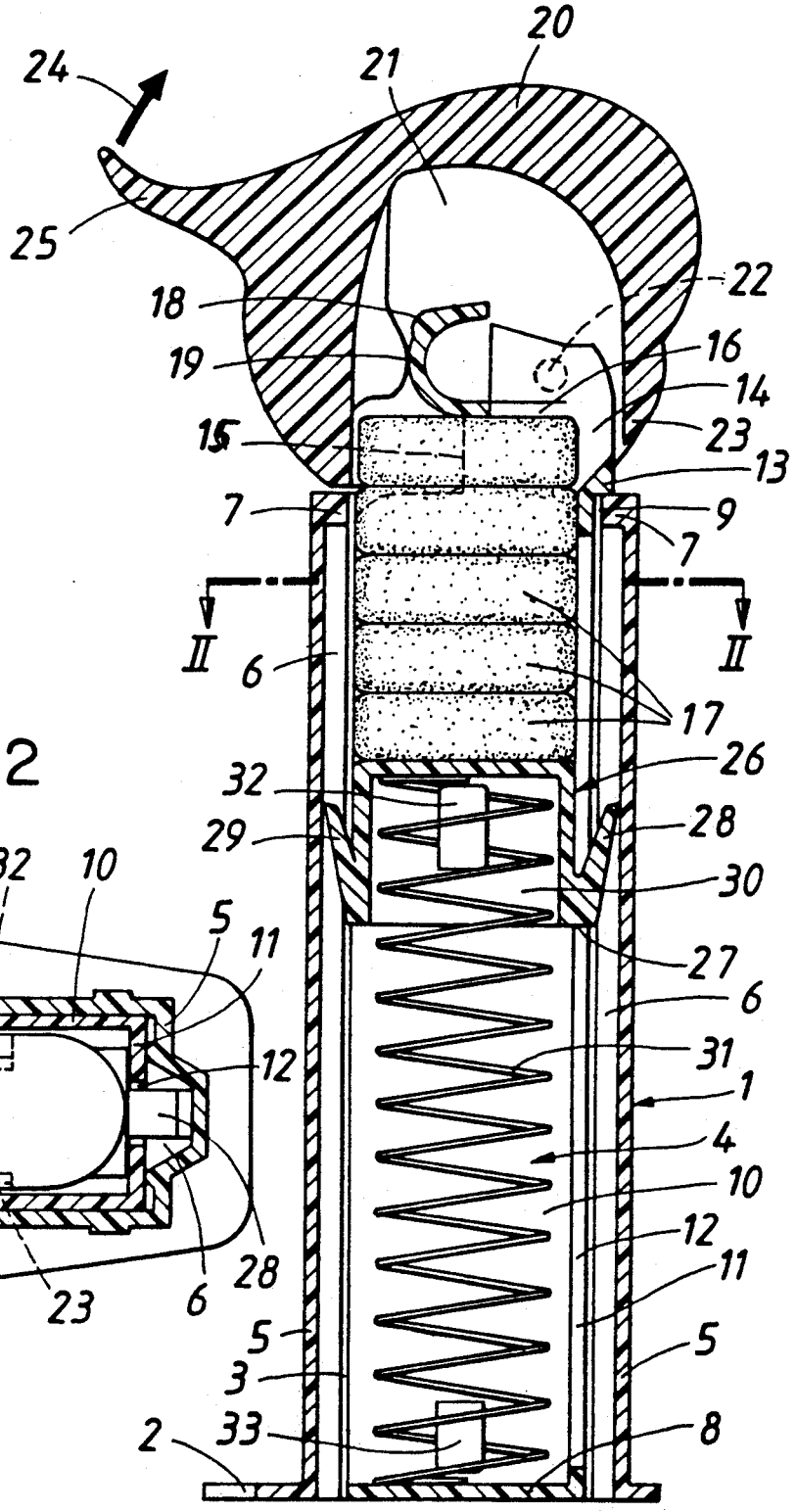
FIG. 1 is a longitudinal sectional view which shows a tablet dispenser in accordance with the invention which dispenser contains some tablets of an initially larger stack of tablets.
Figure 2:
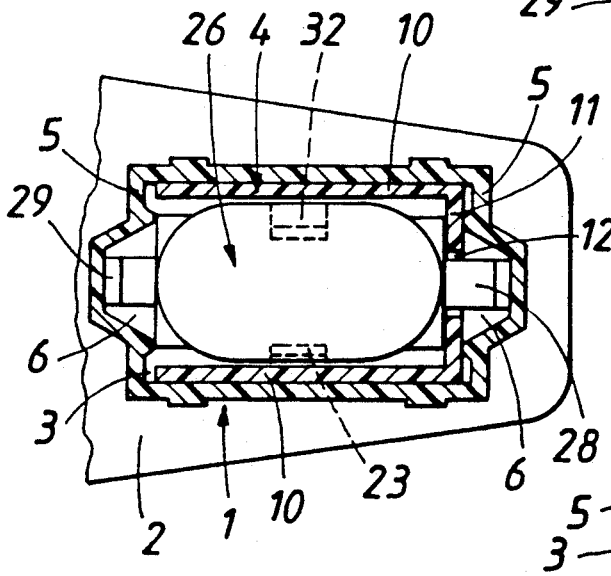
FIG. 2 is a sectional view taken on line II—II in FIG. 1 without the tablets.

Further details and advantages of the invention will become apparent from the following description of an illustrative embodiment shown on the drawing.

The illustrated tablet dispenser comprises a tubular housing 1, which is integrally formed with a base 2, by which the dispenser can be supported in an upright position. The housing 1 defines an internal passage 3 for guiding a drawer 4. The passage 3 and the drawer 4 are substantially rectangular in cross-section. The narrow side walls 5 of the protective housing 1 are integrally formed with longitudinal grooves 6, which are trapezoidal in cross-section and extend continuously from the open bottom end of the housing 1 and at the open top end 9 of the housing 1 are closed by inwardly projecting portions 7 of the housing wall portion. Open housing top end 9 conforms to bottom wall 8 of the drawer 4 so that the drawer may be inserted in the housing through the open top end.

The drawer 4 comprises two side walls 10, which are guided by the side walls of the housing 1, and also comprises a rear wall 11 and the above-mentioned bottom wall 8. The drawer 4 is open in front and in its rear wall 11 is formed with a longitudinal slot 12.

The drawer is adapted to be inserted into the guide passage 3 as far as stop 13 and the side walls 10 of the drawer are formed beyond said stop 13 with extensions 14, which have the edge 15 indicated on the left by broken lines and on the right and at the top by solid lines. A resilient U-shaped member extends between said extensions 14 and has a lower leg which constitutes a stop for the uppermost tablet 17 of a stack of tablets contained in the drawer 4. The bight of the U-shaped member 16 is formed on its outside surface with a cam groove and with a detent nose 18 for cooperation with a counterdetent 19, which protrudes into a cavity 21 of an ejector head 20. The ejector head 20 is pivoted on pivot pins 22 carried by the side wall extensions 14 and carries an ejector claw 23, which extends between said extensions and upon a pivotal movement of the ejector head 20 in the direction of the arrow 24 ejects the uppermost tablet of the stack of tablets out to the left. When the head 20 is in closing position the tablet dispenser is closed at its top by the rim of the cavity 21 and said cavity then accommodates the uppermost tablet of the stack, the extensions 14, the pivot pins 22, the U-shaped member 16 and the counterdetent 19. The outside of head 20 may be ornamental head, such as the head of an animal or fantastic creature. The pivotal movement is preferably facilitated by a grip 25, which may constitute the brim of a hat or cap on the head. By the cooperation of the parts 18, 19 the head 20 will be retained in the illustrated position and in the ejecting position in which the ejector claw extends between the extensions 14 ejects the uppermost tablet to the left.

The drawer 4 contains a pusher 26, which at its top applies pressure to the stack of tablets 17. The pusher 26 has the basic configuration of an open-bottomed cap and is formed with outwardly diverging resilient tongues 28, 29, which project from the bottom rim 27 of the cap at the opposite narrow side walls of the cap. One of said tongues, designated 29, extends into one of the grooves 6 through the front opening of the drawer. The other tongue 28 extends into the other groove 6 through the slot 12. The spring tongues 28, 29 can be inserted into the housing through its open top end 9 with elastic deformation of the tongues and when they have been moved past the closed ends 7 of the grooves 6 will spread into such grooves to assume the illustrated position.

A compression spring 31 is supported at one end in the cavity 30 of the cap and at the other end on the bottom 8 of the drawer and consists of a coil spring having a peripheral surface consisting of a rectangular prism. The top and bottom terminal convolutions of the spring are engaged by respective catching noses 32, 33, which are integrally formed, respectively, on the side wall of the cavity 30 of the pusher 26 and on the side wall of the drawer and are respectively directed toward the top of the cavity 30 and toward the bottom wall 8 of the drawer. When the spring is compressed, at least one convolution of the spring can move between the respective top or bottom and the end of the respective nose 32 or 33 and that nose will then catch the adjacent convolution of the spring as the latter is relaxed.

For assembling the dispenser the spring 31 is inserted into the drawer 4 and the pusher 26 is also inserted into the drawer above the spring so that the spring tongue 28 protrudes out through the longitudinal slot 12. Now the drawer 4 is partly inserted from above into the housing 1 and the pusher 26 is subsequently forced through the open top end 9 of the housing until the spring tongues 28, 29 of the pusher have spread into the grooves 6. The assembling has now been completed. When the drawer is then released and a stack of tablets has not yet been inserted the spring 31 will raise the pusher 26 so that the ends of its tongues 28, 29, which constitute stop noses, engage the projections 7 which close the grooves 6, and will also depress the drawer to the illustrated inserted position. The terminal convolutions of the spring 31 will snap behind the catching noses 32, 33 when or before the drawer has fully been extracted so as to fully compress the spring 31.

When the dispenser has completely been assembled, the drawer 4 can be extended out of the open top end of the tubular housing 1 to an upper position, in which the stops 28, 29 of the pusher 6 engage the stops 7 at the top end of the grooves 6, and the spring 31 is fully compressed between the pusher 26 and the bottom wall 8 of the drawer 4. In that upper position of the drawer 4 its front opening is exposed so that a stack of tablets can be inserted into the drawer above the pusher 26.

For numerous applications it will be sufficient to provide the pusher only on one side with a spring tongue 28 or 29. In that case the housing 1 may be designed as shown and one groove 6 may not be used or one side wall of the housing may not be formed with a groove 6.

I claim:

1. A tablet dispenser comprising a tubular housing which has an open top end, a bottom end, an inside peripheral surface extending between said top and bottom ends and defining an axially extending guide passage, longitudinal track means formed of groove means on said inside peripheral surface which are laterally open toward said guide passage, and pusher stop means closing said groove means at the top of said track means;

a drawer having a rear wall, a bottom wall, a longitudinal side opening opposite to said rear wall, said rear wall, said bottom wall and said longitudinal side opening defining an interior drawer cavity, a stop laterally extending at the top of said drawer over said guide passage, and side wall extensions extending above said top end of said housing forwardly from said rear wall, said drawer being axially movable in said guide passage between a position, in which said stop is spaced at least a predetermined distance above the top end of said housing, and a position, in which said housing engages said drawer stop and said side opening is exposed above said housing;

a pusher mounted in said drawer to be movable along said track means between an upper position, in which said pusher engages said pusher stop means, and a lower position, in which the pusher is disposed below said pusher stop means, so that a stack of tablets, each of which has a height not in excess of said predetermined distance, is adapted to be inserted into said drawer through said exposed side opening above the pusher;

a compression spring axially extending in the interior drawer cavity between said pusher and said bottom wall of said drawer and urging said pusher and said drawer bottom wall axially apart, the compression spring conforming substantially to the drawer cavity, and said pusher comprising a top wall supporting the stack of tablets and elastic means diverging outwardly toward the top wall and extending into said groove means, the elastic means being resiliently deformable by said pusher stop means as said drawer containing said pusher and said spring is forcibly inserted into said housing through said open top end, and said elastic means being adapted subsequently to snap into said groove means; and an ejector mounted on said drawer above said housing and operable to eject an uppermost tablet of said stack between said side wall extensions transversely to said guide passage.

2. The tablet dispenser set forth in claim 1 in which said pusher consists of a cap having said top wall and containing an end portion of said spring, said drawer is internally provided with a first laterally inwardly directed projection defining a first gap with said bottom wall of said drawer, said pusher is internally provided with a second laterally inwardly directed projection defining a gap with said top wall of said pusher, said spring consists of a coil spring having a bottom convolution extending through said first gap and a top convolution extending through said second gap, and said first and second projections permitting said bottom and top revolutions to move past said first and second projections, respectively, as said pusher is depressed to compress said spring and permitting said bottom and top convolutions subsequently to snap into said first and second gaps, respectively.

3. The tablet dispenser set forth in claim 2, wherein said first and second projections consist of noses.

4. The table dispenser set forth in claim 1, wherein a pivot which is normal to said longitudinal track means is mounted on said side wall extensions, said ejector is pivoted on said pivot and is pivotally movable from an initial position to eject said uppermost tablet, and detent means are provided for resiliently locking said ejector in said initial position and comprise a first detent member mounted on said side wall extensions and a second detent member provided on said ejector and arranged to be in pressure contact with said first detent member when said ejector is in said initial position, at least one of said detent elements being resiliently deformable by the other.

* * * * *